US008316786B2

(12) United States Patent
Johanek et al.

(10) Patent No.: US 8,316,786 B2
(45) Date of Patent: Nov. 27, 2012

(54) LIFT SYSTEM FOR AN ELEVATOR

(75) Inventors: William R. Johanek, Saint Simons Island, GA (US); Dale Hengel, Minneapolis, MN (US)

(73) Assignee: Par Systems, Inc., Shoreview, MN (US)

( * ) Notice: Subject to any disclaimer, the term of this patent is extended or adjusted under 35 U.S.C. 154(b) by 226 days.

(21) Appl. No.: 12/709,732

(22) Filed: Feb. 22, 2010

(65) Prior Publication Data

US 2010/0212569 A1 Aug. 26, 2010

Related U.S. Application Data

(60) Provisional application No. 61/154,215, filed on Feb. 20, 2009.

(51) Int. Cl.
*B63B 27/00* (2006.01)

(52) U.S. Cl. ..... 114/268; 114/48; 114/263; 187/250; 187/264

(58) Field of Classification Search ..... 114/44, 114/48, 50, 263, 268; 405/3, 4, 7; 414/254, 414/255, 257, 260, 264, 281; 187/250, 254, 187/255, 256, 264
See application file for complete search history.

(56) References Cited

U.S. PATENT DOCUMENTS

| | | | | |
|---|---|---|---|---|
| 3,985,207 | A * | 10/1976 | Petit | 187/208 |
| 4,300,659 | A | 11/1981 | Silverstrand | |
| 4,329,082 | A * | 5/1982 | Gillis | 405/3 |
| 5,988,941 | A * | 11/1999 | Sargent et al. | 405/3 |
| 6,106,210 | A | 8/2000 | Toxer | |
| 6,935,807 | B2 * | 8/2005 | Becker | 405/3 |
| 7,117,805 | B2 * | 10/2006 | Shackelford, Jr. | 114/44 |
| 7,402,013 | B2 | 7/2008 | Clive-Smith | |
| 7,413,378 | B2 * | 8/2008 | Way | 405/4 |

FOREIGN PATENT DOCUMENTS

| | | | |
|---|---|---|---|
| DE | 202007018036 | U1 | 12/2007 |
| EP | 1717171 | A2 | 11/2006 |
| GB | 1107250 | A | 3/1968 |
| WO | WO 2005120895 | | 12/2005 |

OTHER PUBLICATIONS

Official Search Report of the European Patent Office in counterpart foreign application No. PCT/US2010/024883 filed Feb. 22, 2010.
European Search Report of the European Patent Office Patent Office in counterpart foreign application No. PCT/US2010/024883 filed Feb. 22, 2010.
Written Opinion of the European Patent Office Patent Office in counterpart foreign application No. PCT/US2010/024883 filed Feb. 22, 2010.
Written Opinion and Search Report of the Austrian Patent Office Patent Office mailed Aug. 3, 2012 in counterpart Singapore Application No. 201106002-7 filed Feb. 22, 2010.

* cited by examiner

*Primary Examiner* — Lars A Olson
(74) *Attorney, Agent, or Firm* — Steven M. Koehler; Westman, Champlin & Kelly, P.A.

(57) ABSTRACT

A lift assembly is provided for a platform such as used on a ship. The platform can have four spaced apart hitch points. In one embodiment, the lift assembly includes four trolley drive assemblies, each trolley drive assembly including a trolley guidable along a guide rail, and a drive configured to displace the trolley along the guide rails, each trolley being coupled to at least one hitch point. In a second embodiment, a tension leveling assembly is provided in a trolley drive assembly and is configured to couple each of the wire ropes to the trolley and maintain substantially the same amount of tension in each wire rope. In a third embodiment, the lift assembly can be provided on a ship that also includes a vessel for holding water. The lift assembly includes an electric drive that operates as generator and generates current during lowering of the platform, A resistive device is disposed in the vessel and connected to the drive to receive current, the resistive device being configured to dissipate heat into the vessel.

19 Claims, 9 Drawing Sheets

LIFT SYSTEM FOR AN ELEVATOR

CROSS REFERENCE TO RELATED APPLICATION

This application claims the benefit of U.S. Provisional Patent application entitled "LIFT SYSTEM FOR AN ELEVATOR", having Ser. No. 61/154,215, filed Feb. 20, 2009, which is incorporated herein by reference in its entirety.

BACKGROUND

The discussion below is merely provided for general background information and is not intended to be used as an aid in determining the scope of the claimed subject matter.

Lift platforms are found on ships. The platforms are used to transfer heavy loads between decks of the ship. A lift assembly located within the hull of the ship raises and lowers the platform using wire ropes and sheaves. Improvements in the lift assembly and the manner in which it operates are continually needed.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the Background.

A lift assembly is provided for a platform such as used on a ship. The platform can have four spaced apart hitch points. In one embodiment, the lift assembly includes four trolley drive assemblies, each trolley drive assembly including a trolley guidable along a guide rail, and a drive configured to displace the trolley along the guide rails where each trolley is coupled to at least one hitch point. To provide redundancy and to help equalize loads carried by the platform, each trolley can be coupled to two of the four spaced-apart hitch points.

In an embodiment, each drive assembly includes a motor and a flexible member operable in tension to lift the platform. In addition, a support structure is provided for the guide rail as well as a guide configured to receive a portion of the flexible member not in tension between the drive and the trolley. Each drive assembly can further include a second flexible member having a first end connected to the trolley and a second end connected to an end of the first-mentioned flexible member remote from the trolley. The first-mentioned flexible member and the second flexible member of each drive assembly form a loop such that the second flexible member is configured to pull the portion of the first-mentioned flexible member not in tension between the drive and the trolley along the guide. A mechanical hard stop can be provided to limit movement of each of the trolleys on each corresponding guide rail.

The trolley drive assemblies can be arranged in pairs with a first trolley drive assembly of each pair stacked upon a second trolley drive assembly of each pair such that the guide rail of the first trolley drive assembly is disposed above the guide rail of the second trolley drive assembly. This provides a compact assembly that can be particularly advantageous when used on a ship where space is at a premium.

In an embodiment, a lift assembly for a platform includes a trolley drive assembly including a trolley guidable along a guide rail, and a drive configured to displace the trolley along the guide rail. A plurality of wire ropes is provided for lifting the platform. A tension leveling assembly is configured to couple each of the wire ropes to for each of the trolleys to maintain substantially the same amount of tension in each wire rope. The tension leveling assembly can comprise a plurality of elongated rods, wherein an elongated rod is coupled to each one of the wire ropes and coupled to each corresponding trolley wherein displacement of the elongated rod relative to the trolley adjusts the tension in the corresponding wire rope.

In one embodiment, each elongated rod is coupled to its corresponding trolley with a spring element used to maintain the desired tension in each corresponding wire rope. The elongated rods can be threaded and a nut provided that is coupled to the spring nut such that rotation of the nut adjusts the tension in the corresponding wire rope. In a further embodiment, each elongated rod slideably extends though an aperture in the trolley, wherein each elongated rod has threads that are on a side of the trolley opposite the corresponding wire rope, and wherein the spring element is disposed between the side of the trolley and corresponding nut.

The lift assembly can be provided on a ship that also includes a vessel for holding water. In this embodiment, the lift assembly includes an electric drive that operates as generator and generates current during lowering of the platform. A resistive device is disposed in the vessel and connected to the drive to receive current, the resistive device being configured to dissipate heat into the vessel. The vessel can be configured to hold a flow of water where the resistive device heats the flow of water. If desired, a baffle can be provided and configured so to cause turbulent contact of the water with the resistive device. The vessel can also be configured to hold water and vent steam, wherein the resistive device is configured to convert at least some of the water into steam.

DETAILED DESCRIPTION OF ILLUSTRATIVE EMBODIMENTS

Figure 1:
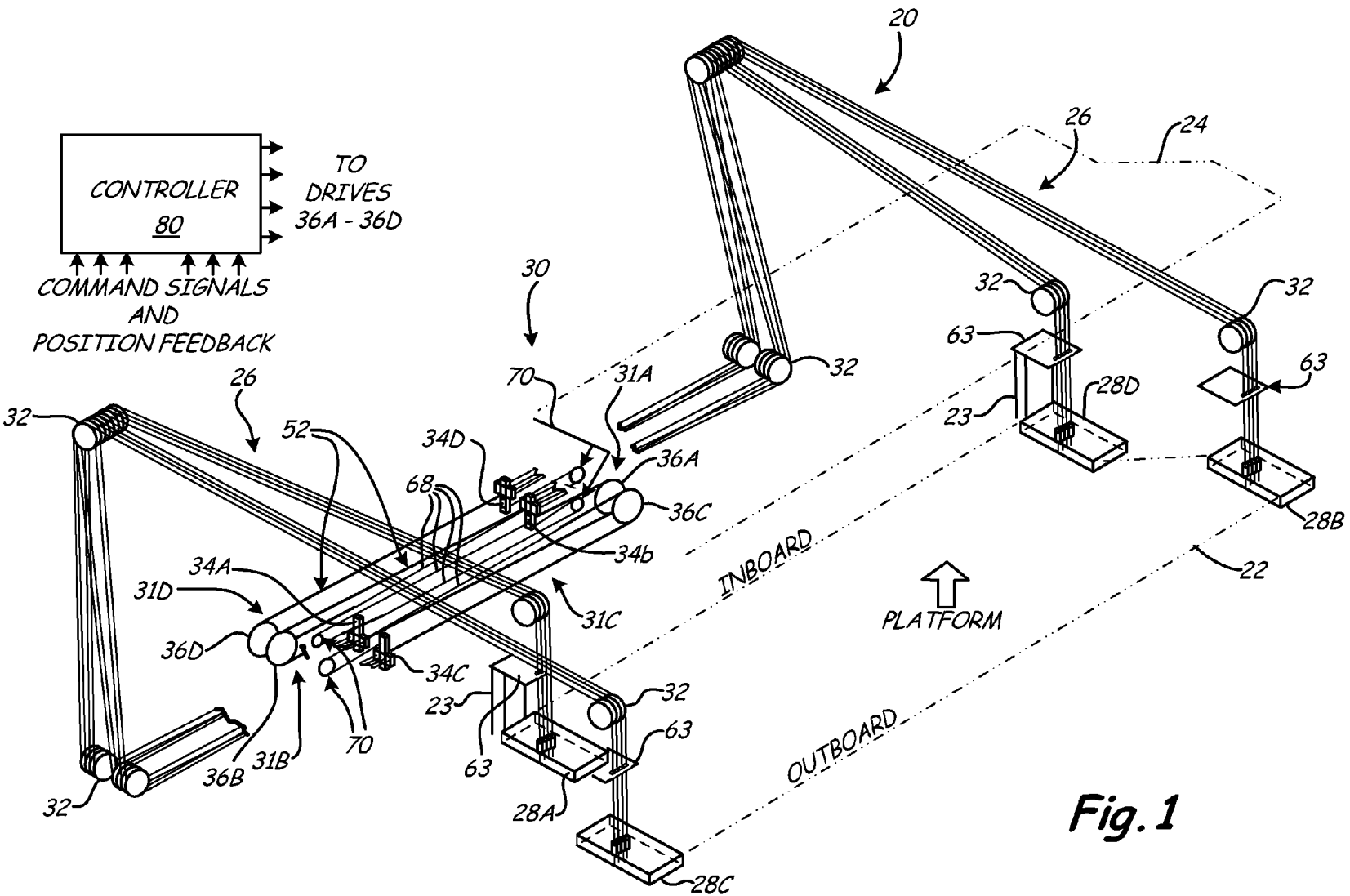
FIG. 1 is a schematic illustration of a lift system of platform.

A lift mechanism 20 for, for example, a deck edge elevator platform 22 on a ship herein exemplified as an aircraft carrier 24 is schematically illustrated in FIG. 1. The platform 22 is suspended by wire ropes 26 at four hitch points 28A, 28B, 28C and 28D. At ends remote from the hitch points 28A-28D, the wire ropes 26 are connected to a lift assembly 30 typically located internally in the aircraft carrier 24. Sheaves 32 located on the aircraft carrier at various locations guide the wire ropes 26 within the aircraft carrier 24 between the lift assembly 30 and the platform 22. It should be noted that guide rails 23 for the platform 22 are provided for only the inboard side of the platform 22 having hitch points 28A and 28D adjacent the edge of the aircraft carrier 24, while the outboard edge of the platform 22 having hitch points 28B and 28C is unguided, being only supported by the wire ropes for hitch points 28B and 28C.

The lift assembly 30 includes four trolley drive assemblies 31A, 31B, 31C and 31D having trolleys 34A, 34B, 34C and 34D (schematically illustrated). Each trolley 34A-34D is driven by a drive 36A, 36B, 36C and 36D, respectively. The lift assembly 30, trolleys 34A-34D and drives 36A-36D will be discussed below in further detail; however, at this point, one aspect of the present invention includes minimizing and equalizing the load carried by each trolley 34A-34D during operation of the platform 22. In this manner, the load carrying capacity of each trolley drive assembly 31A-31D can be minimized and equalized.

In operation, the loads carried by the wire ropes 26 for each of the hitch points 28A-28D are not all the same. In particular, wire rope loads for the outboard hitch points 28B and 28C are typically greater than the loads carried by the wire ropes 26 for inboard hitch points 28A and 28D. In order to balance the loads carried by each of the trolley assemblies 31A-31D, each trolley 34A-34D is connected to one inboard hitch point 28A or 28D as well as to one outboard hitch point 28B or 28C. In the embodiment illustrated, there are four wire ropes connected to each hitch point 28A-28D. For each hitch point 28A-28D, two wire ropes are connected to a first trolley, while the remaining two wire ropes are connected to another trolley. Although herein illustrated where two wire ropes are connected to each trolley 34A-34D and corresponding hitch point 28A-28D, this construction should not be considered limiting wherein a single wire rope could be used although use of a plurality or ropes is beneficial. In one embodiment as illustrated, trolley 34A is connected to hitch points 28A and 28C; trolley 34B is connected to hitch points 28B and 28D; trolley 34C is connected to hitch points 28C and 28A; and trolley 34D is connected to hitch points 28D and 28B. Hence, in this embodiment, each trolley 34A-34D is connected to two hitch points 28A-28D that are on the same end (i.e., aft end or forward end of ship 24) of the platform 22. In an alternative embodiment, each trolley 34A-34D can be connected to inboard and outboard hitch points that are diagonally opposed to each other, although the wire roping would be more extensive. In the foregoing configurations when all four trolleys 34A-34D and corresponding drives 36A-36D are operating, each trolley 34A-34D and corresponding drive 36A-36D is coupled to an inboard hitch point and an outboard hitch point and lifts one-half of an end (forward or aft) of the platform 22. However, it should be noted that the lift assembly 30, which forms other aspects of the present invention, can be connected to the platform 22 in a manner where each trolley 34A-34D is connected to a single hitch point 28A-28D.

FIGS. 2-7 illustrate features of the lift assembly 30. Generally, each drive 36A-36D includes a motor (electric, pneumatic and/or hydraulic) 40 coupled to a gear reducer 42 that in turn drives a flexible member driver such as a sprocket 44. In the embodiment illustrated, a brake 46 is also provided. Herein, the brake 46 is operably coupled to the output shaft of motor 40 although other locations such as but not limited to the output shaft of gear reducer 42 can also be used. The brake 46 can take many forms as is known in the art. In the embodiment illustrated, the brake 46 includes a disk 48 and a caliper 50 that selectively holds the disk 48 in a stationary position, when desired.

Figure 5:
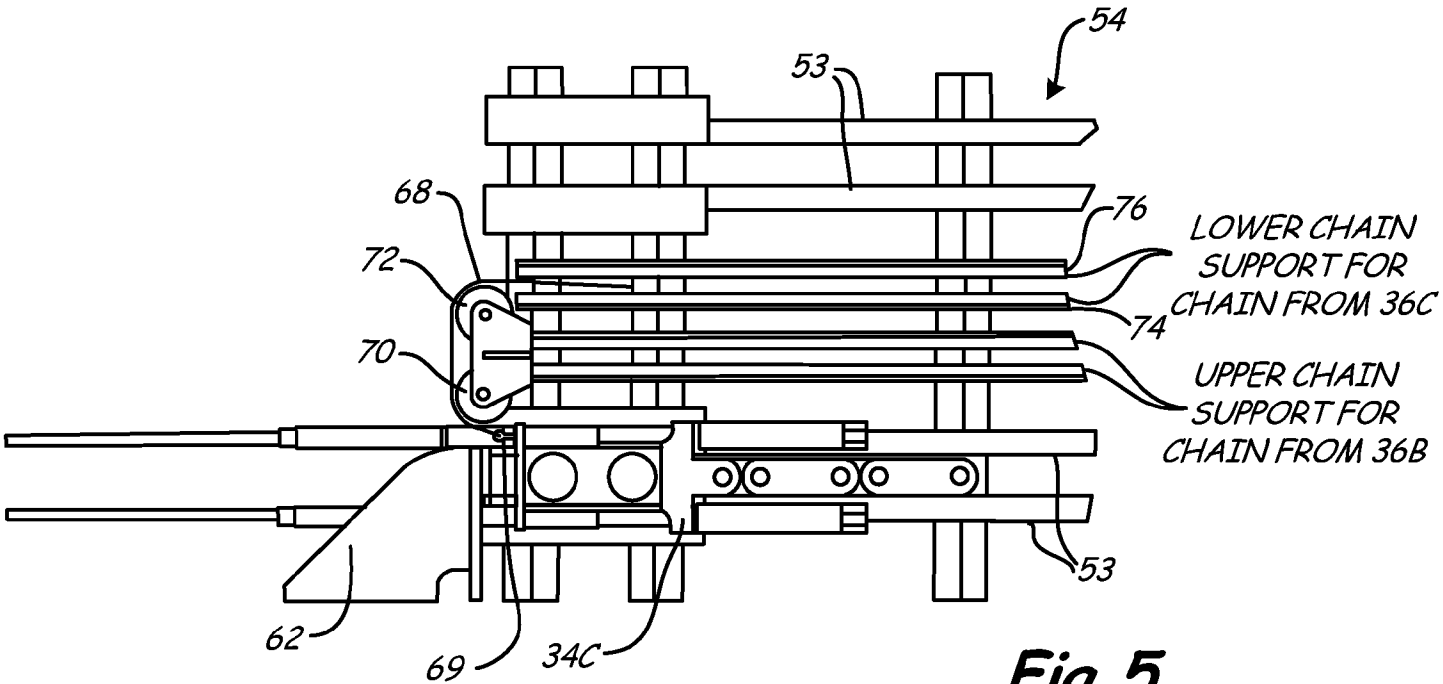
FIG. 5 is a side elevational view of a portion of the trolley assembly.
Figure 6:
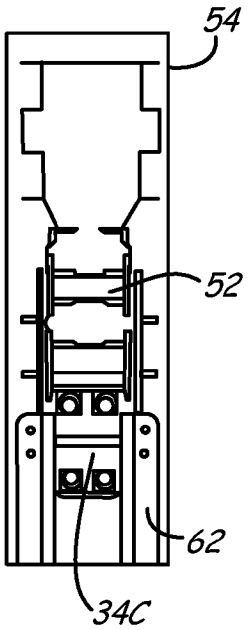
FIG. 6 is an end view of the trolley assembly.

In the exemplary embodiment, the sprocket 44 drives or displaces a chain 52, wherein one end of each chain 52 is connected to a trolley 34A-34D. (It should be noted only portions of the chains are illustrated in some of the figures to provide clarity for other elements.) Each trolley 34A-34D is guided by a guide rail, herein a pair of guide rails 53, in a support structure 54 (FIG. 5). As illustrated, the trolleys 34A-34D and the drives 36A-36D are organized in pairs facing each other wherein two trolleys are operable and utilize a common support structure 54 so as to minimize space. In one embodiment, each trolley 34A-34D traverses the support structure 54 substantially from one end to the other which corresponds to platform 22 moving from its lowermost position to its uppermost position and vice versa. To provide a compact lift assembly 30 and efficiently utilize available space, the trolleys 34A-34D are stacked upon each other in pairs. In the embodiment illustrated, trolleys 34A and 34C comprise lower trolleys in each respective support structure 54, while trolleys 36B and 36D comprise upper trolleys in each respective support structure 54. Mechanical hard stops 62 are provided to limit extension of each corresponding chain 52, and further, to provide a hard stop for the platform 22 in its lowermost position. In its uppermost position, platform 22 is held by tension in the wire ropes 26 and corresponding chains 52 as each of the trolleys 34A-34D are pulled away from each of the corresponding mechanical stops 62 to the other end of the support structure 54. Brakes 46 are operated to hold the platform 22 in its uppermost position. Brakes 46 are configured to operate in a fail safe manner (for example, where the calipers 50 are held back in a non-braking position by a hydraulic, pneumatic or electrical device and are moved to a braking position by a spring) so as to actively hold the platform 22 when the power to the motors 40 is off or lost.

Figure 2:
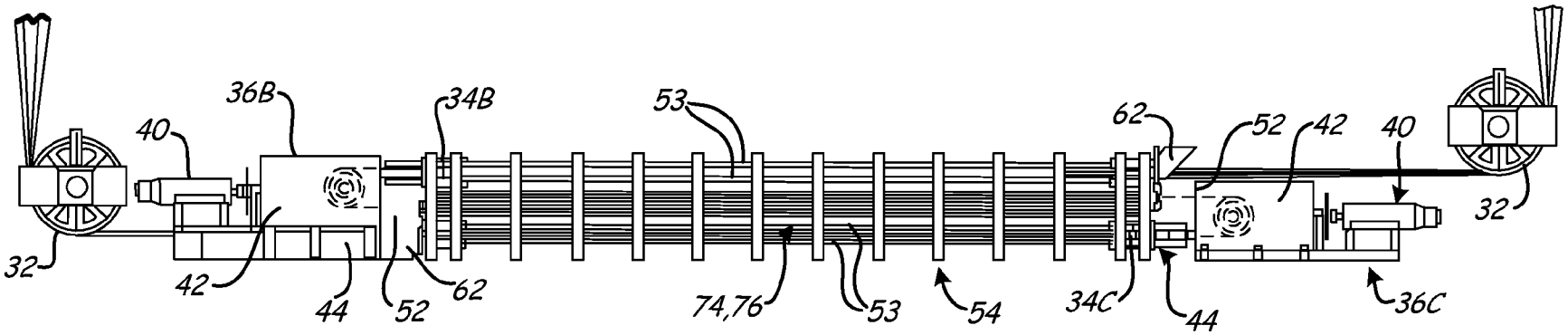
FIG. 2 is a side elevational view of a pair of trolley assemblies.
Figure 3:
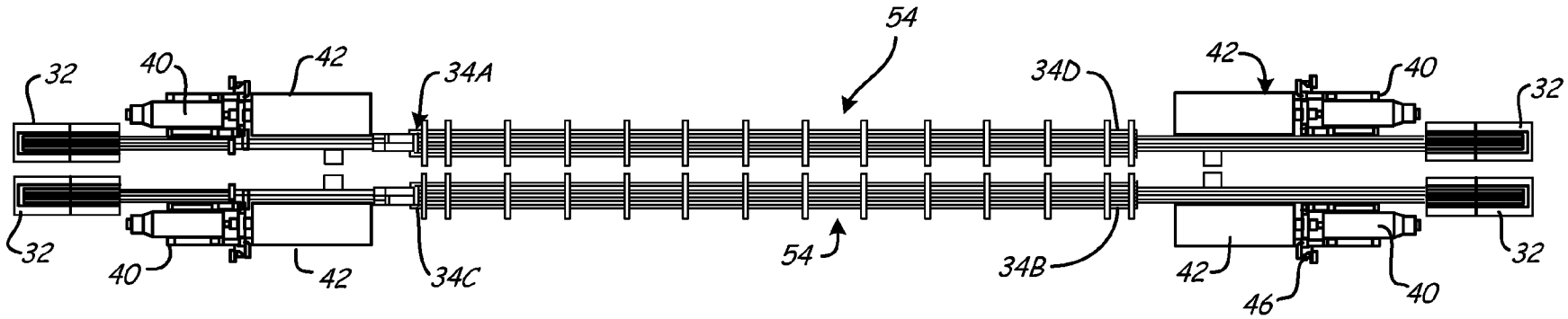
FIG. 3 is a top plan view of four trolley assemblies.
Figure 4:
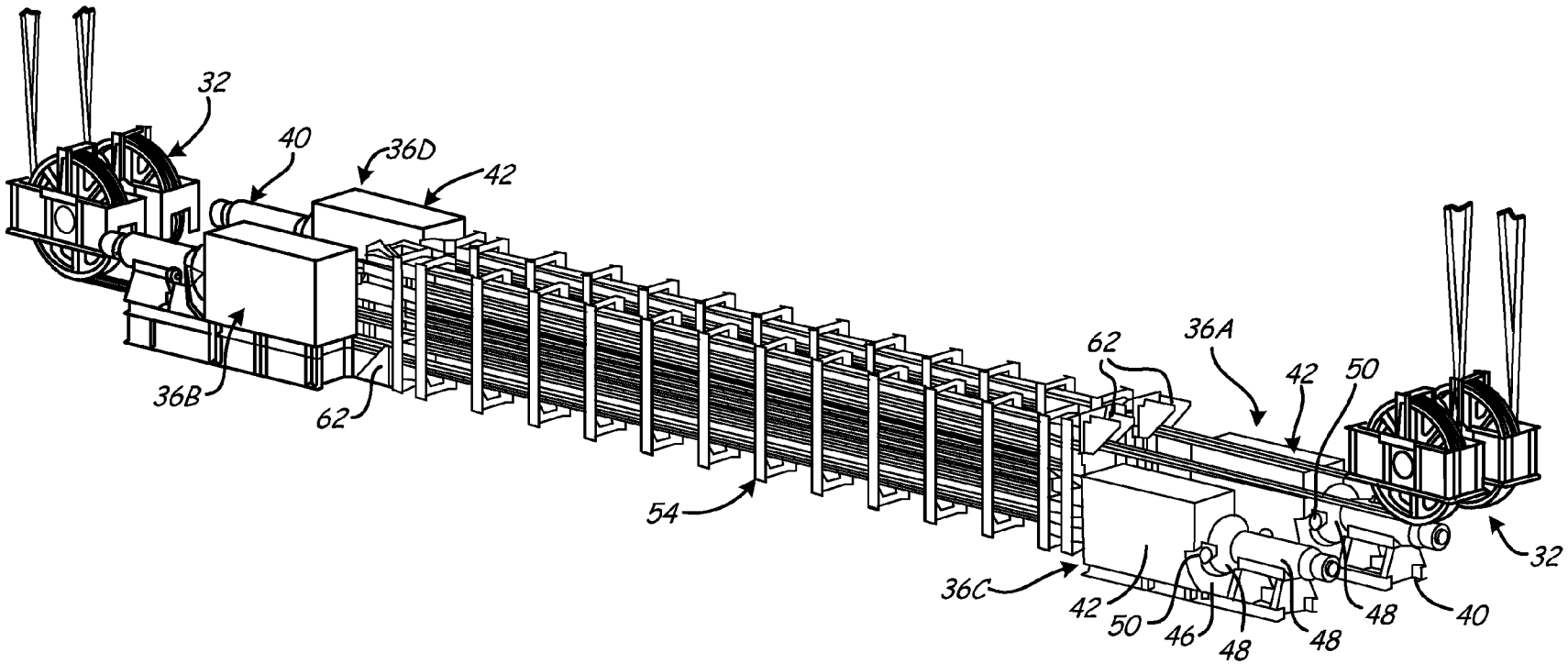
FIG. 4 is a perspective the pair of trolley assemblies.

Referring back to FIG. 1 and as indicated above, one end of each chain 52 is connected to one of the trolleys 34A-34D. The other end of the chain 52 is connected to a second flexible member 68 (herein exemplified as a wire rope) that in turn, is connected back to the same trolley 34A-34D. Hence, the chain 52 and wire rope 68 of each trolley are connected to the trolley in order to form a single loop. Referring to FIGS. 2 and 5, and to trolley 34C by way of example, the first end of the chain 52 is connected to the trolley 34C. This portion of the chain is held in tension by the gear reducer 42 and corresponding sprocket 44 of drive 36C. It should be noted, the pitch diameter of the sprocket 44 should be as small as possible to reduce the amount of torque needed for operation, and hence, the torque capability of the gear reducer 42. During operation, the trolley 34C traverses the support structure 54 from one end to the other. In FIG. 5, the trolley 34C is against its stop 62 and the platform 22 is in its lowermost position. Pulling of the chain 52 by the drive 36C to the right in FIG. 5 raises the platform 22.

To control an end of the chain remote from the trolley 34C, the wire rope 68 is connected to the end of the chain 52 (schematically illustrated in FIG. 1) and then back to the trolley 34C and secured at location 69 in FIG. 5. The wire rope 68 is guided by two sheaves 70 and 72 (one of which is illustrated in FIG. 1) into chain supports 74 and 76 which receive that portion of the chain which is not held in tension between the sprocket 44 and the trolley 34C. As indicated above, when the trolley is furthest away from its corresponding drive and resting upon mechanical stop 62, the chain 52 extends along the length of the support structure 54 between the sprocket 44 and the trolley 34C. As the trolley 34C is retracted toward its corresponding drive 36C, the wire rope 68, being attached to the trolley 34C, is also pulled in order to pull an end of the chain remote from the trolley 34C within guide support structure 54 and along corresponding chain support 74 and 76. In the embodiment illustrated, movement of the trolley 34C toward drive 36C eventually causes the platform 22 to contact hard stops 63 when it reaches the flight deck. The controller 80 is programmed to move the trolleys 34 an additional distance to tension the wire ropes 26 so the platform 22 is held tightly against the hard stops 63 and does not move as it is loaded or unloaded. If desired, a mechanical hard stop can be provided on the support structure 54 to correspond to the uppermost position of the platform 22.

As the trolley 34C returns towards its corresponding stop 62 (to the left in FIG. 5), the chain 52 pulls the wire rope 68 over the sheaves 70 and 72 and along the support structure 54 (to the right in FIG. 5). Each of the other trolleys 34A, 34B and 34D, operates in a similar manner. A controller 80 schematically illustrated provides signals to each of the drives 36A-36D and brakes 46 and receives command signals as well as position indications from sensors for the platform 22, the lift assembly 30, and/or drives 36A-36C. Each of the motors 40 can comprise variable frequency motors that each have internal resolvers (not shown) that can be used to indicate the position of the platform 22, but moreover, can be used by the controller 80 during both lifting as well as lowering of the platform 22 such that each of the drives 36A-36D are synchronized.

Figure 8:
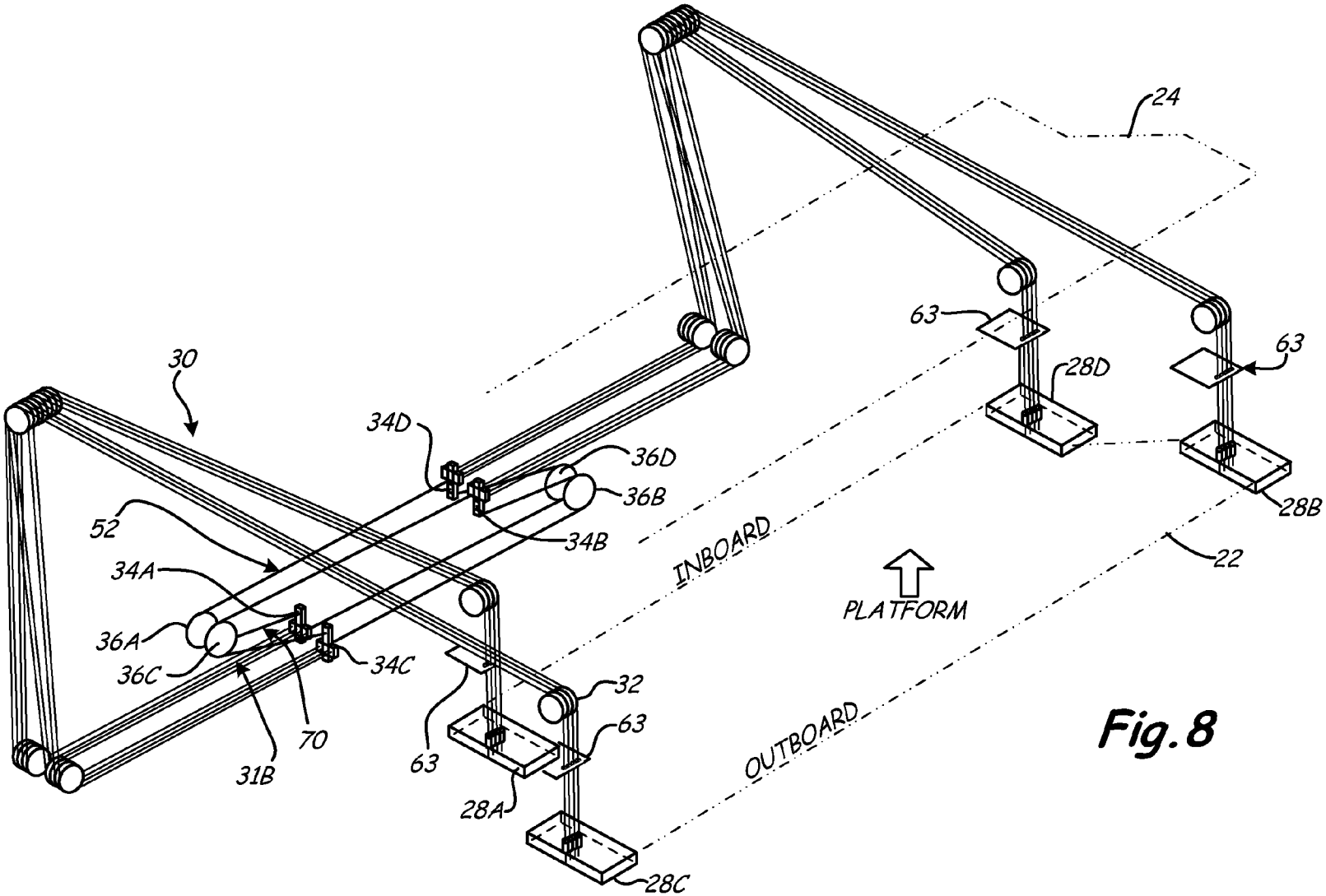
FIG. 8 is a schematic illustration of a second embodiment of a lift system of platform.

In the embodiment illustrated, each trolley 34A-34D is independent. However, in another embodiment as illustrated in FIG. 8 each end of each chain 52 for each drive 36A-36D is connected to two trolleys. In this embodiment, the wire rope 68 and sheaves 70 and 72 are eliminated. As for example, drive 36B pulls trolley 34C trolley 34C pulls chain 52 off the sprocket 44 on drive 36C.

The embodiments described above allow operation of the platform 22, and in particular, return of the platform 22 under rated load to its uppermost position whereat it can be locked in place by a mechanism not pertinent to the present invention under casualty conditions. For instance, if necessary, the drives 36A-36D can be operated slowly so as to reduce power consumption. In addition, if there is a single point failure of one of the trolley/drive assemblies 31A-31C such as failure of a motor 40 or gear reducer 42, or where all the wire ropes 26 for one hitch point 28A-28D become disconnected, the other three trolley/drive assemblies of the lift assembly 30 can operate to move the platform 22. If necessary, the trolley of the disabled trolley/drive assembly can be disconnected from its corresponding drive and moved manually. To accomplish this, a portable device such as a chain fall is connected to an anchor and to the trolley 34 of the now disconnected drive. A pin, not illustrated, connecting the chain 52 to the trolley 34 is removed allowing the chain 52 to drop clear of the trolley 54. A pin, not illustrated, connecting the wire rope 68 to the chain 52 is also removed. As the remaining three trolleys 34 lift the platform the disabled trolley can be easily moved manually.

It should also be noted in the event of loss or other problems with the controller 80, manual operation of the drives 36A-36C would be available. A manual override circuit 81 (FIG. 9B) would be hard wired to the drives 36A-36C to control the drives 36A-36C to provide command signals. In the event of a controller problem, user selection of the manual override condition would command the drives 36A-36C to run off of a default set of parameters internal to the drives 36A-36C. These parameters would be set to operate the platform 22 in a simplified profile using only the required features important to controlling platform motion. Limit sensing and other non-critical feedback from the system would be ignored to ensure that platform motion can proceed. (Other control circuits 79, 83 and 85 are provided for the machinery room, galley deck and hanger deck, respectively.)

Although illustrated and described with a chain 52 and sprocket 44, other flexible members operating in tension that can be used include a belt, cogged belt, rope, wire rope, etc. If necessary, the sprocket can be replaced with a capstan depending on the flexible member used. Furthermore, other types of prime movers besides a drive that pulls on a flexible member operating in tension can also be used. For instance, a linear actuator (electric, hydraulic and/or pneumatic) or screw drive can be used in lift assembly 30 so as to control displacement of each of the trolleys 34A-34D. In yet another embodiment, each trolley can include a suitable driver device such as a sprocket connected to and carried by the trolley. A motor (hydraulic, pneumatic and/or electric), which can also be carried by the trolley, drives the sprocket that engages a gear rack extending along a portion of the support structure 54.

Figure 7:
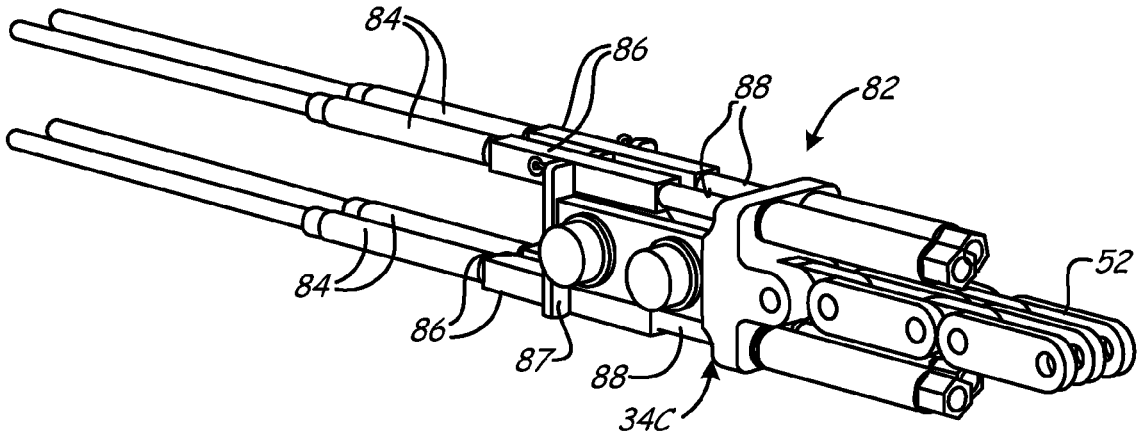
FIG. 7 is a perspective the a trolley.

In another aspect of the present invention, it is beneficial to equalize, or substantially equalize tension in each of the ropes for each hitch point 28A-28D. Referring to FIG. 7, a tension leveling assembly 82 operably couples each of the wire ropes from the hitch point to the trolley 34C, herein by way of example. Chain 52 is illustrated although other flexible members or types of drives such as actuators can be used as discussed above. In the embodiment illustrated, each wire rope terminates at a fitting 84 that is coupled to a receiver 86, herein by mating threads between the fitting 84 and receiver 86. Each of the receivers 86 includes an elongated rod 88 having threads on an end thereof that mate with a nut 102. Generally, displacement of the elongated threaded rod 88 relative to its corresponding trolley 34 adjusts the tension in the corresponding wire rope. A bracket 87 inhibits rotation of the receivers 86.

To equalize the tension in each of the wire ropes 26, during connection of the trolley 34C to the platform 22, the wire ropes 26 are connected to the trolley 34C using the fittings 84, receivers 86, beveled washer assembly 104 (operating as a spring element) and nuts 102. The wire ropes 26 are then passed through any necessary sheave (as illustrated in FIG. 1) and connected to the platform 22 at one of the hitch points 28A-28D while the platform 22 is in the uppermost position. In the embodiment illustrated, the elongated rods 88 slideably pass through apertures provided in the trolley 34. Each of the nuts 102 is then tightened so as to displace the elongated rod 88 relative to the trolley and generate the desired tension in each of the wire ropes 26. Tightening of each nut 102 causes tension forces in the wire rope 26 to be reacted through the beveled washer assembly 104 to the trolley 34C. If desired, the elongated rods 88 can threadably mate with the trolley directly.

Figure 9A:
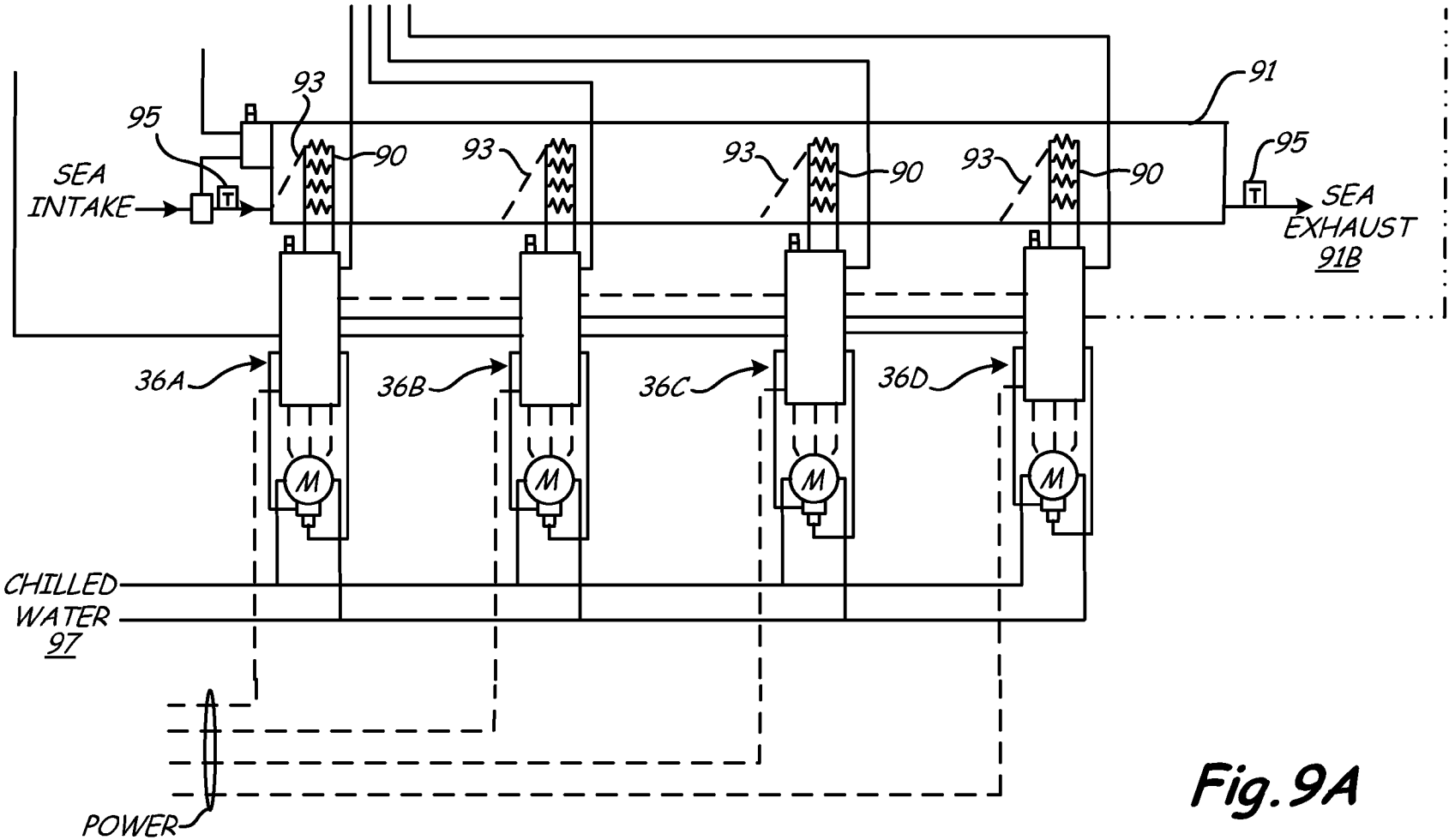
FIGS. 9A and 9B are a circuit diagram for power and control and a schematic diagram for heat dissipation.
Figure 9B:
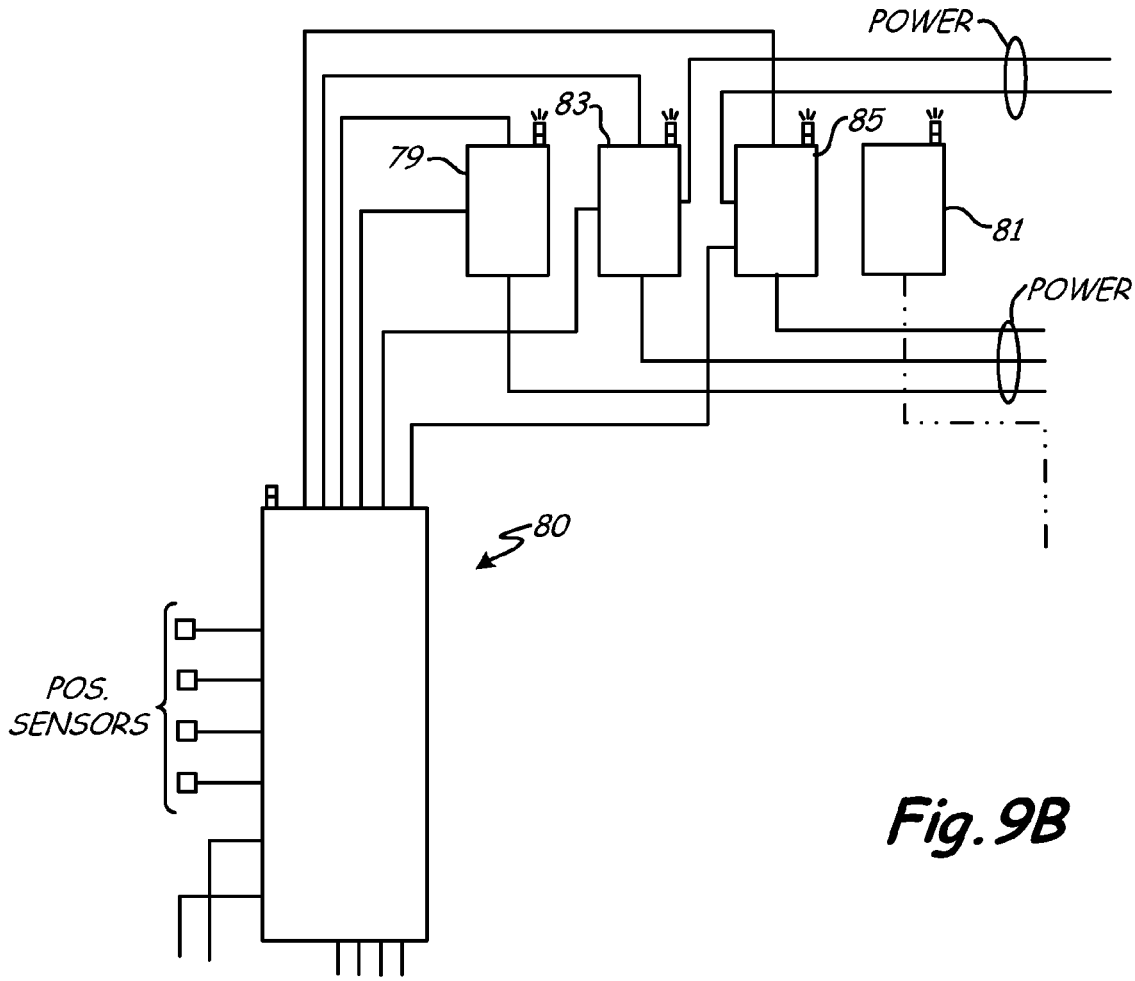

In the embodiments described above where the drives 36A-36D comprise electric motors 40, a significant amount of generated energy is created when the platform 22 is lowered to its lowermost position. Specifically, during lowering, the trolleys 34A-34D move away from each respective drive 36A-36D thereby causing the sprocket 44, gear reducer 42 and motors 40 to rotate in the reverse direction. In this condition, the motors 40 operate as generators. Although operating in this manner is beneficial in that it decreases the speed of which the platform 22 is lowered, the energy generated is quite substantial. As another aspect of the present invention, a system is provided to dissipate the generated energy. Referring to FIGS. 9A and 9B, each motor 40 is operably coupled to a resistive device 90 for heat dissipation. Each of the resistive devices 90 are submerged in an enclosure 92 that can hold water or a flow of water, such as sea water, within the ship 24. In view of the corrosive effects of sea water, the resistive devices 90 are formed of a material to work in such an environment. For instance, the resistive devices 90 can be formed of an alloy comprising copper and a nickel. Indeeco of St. Louis, Mo. sells resistive devices suitable for this purpose.

During the lowering cycle of the platform 22, re-generated energy harnessed by the drives 36A-36C will be directed into resistors 90 (heating elements) submerged the enclosure 92, which in one embodiment can comprise a seawater circulation vessel 91 having intake 91A and exhaust 91B. In this embodiment, the sea water passes through these heating elements in a single pass arrangement. In a further embodiment, the sea water is directed past these heating elements 90 through a set of baffles 93 (schematically illustrated) to allow for continuous, turbulent flow to achieve increased contact of the water with each resistive element 90. The water will be delivered to the seawater circulation vessel 91 from an on board seawater system. Once the water has passed through the vessel 91, it is returned back to the sea. The heat generated through this process will transfer continuous electrical energy into the water causing a nominal temperature rise (e.g. 12-50 degrees Fahrenheit) based on the amount of water supplied. Sensors 95 provide feedback to controller 80 of incoming and outgoing water temperatures and flow. Chilled water 97 is provided for the drives 36A-36C.

As an alternative to the pass through vessel design described above, a "boil off" design can be employed. This design would use a vented holding tank filled with sea water. In this embodiment, submerged resistors 90 would then transfer the electrical energy into the water generating steam that would then be vented externally into the atmosphere. This design would not require a constant supply of fresh seawater. Only periodic purging and refilling of water in the vessel would be required and this could be controlled automatically from the elevator control system.

Sea water is used throughout a ship for various functions such as fire protection. Dissipation of the generated energy as heat from lowering of the platform, and in particular, in sea water is advantageous for it efficiently dissipates the heat while not creating an abnormally hot air environment in a portion of the ship 24. It should be noted that this aspect of the present invention is not limited to an electric motor 40 for driving a sprocket 44 that in turn drives a chain 52 to displace a trolley. Rather any form of mechanical linkage aptly coupled to the electric motor 40 to lift the platform 22 would typically cause the motor 40 to operate as a generator when the platform 22 is lowered. In other words, this aspect of the present invention can be used to dissipate heat in a ship due to lowering of the platform 22 that causes the lifting motor(s) to operate as a generator regardless of the form of the mechanical linkage coupling the motor(s) to the platform 22.

Although the subject matter has been described in language specific to structural features and/or methodological acts, it is to be understood that the subject matter defined in the appended claims is not necessarily limited to the specific features or acts described above as has been determined by the courts. Rather, the specific features and acts described above are disclosed as example forms of implementing the claims.

What is claimed is:

1. A lift assembly for a platform, the platform having four spaced apart hitch points, the lift assembly comprising:

four trolley drive assemblies, each trolley drive assembly including a trolley guidable along a guide rail, and a drive configured to displace the trolley along the guide rail, each trolley being coupled to at least one hitch point and wherein each trolley is coupled to two of the four spaced apart hitch points.

2. The lift assembly of claim 1 wherein each drive assembly includes a motor and a flexible member operable in tension to lift the platform.

3. The lift assembly of claim 2 wherein the guide rail is disposed on a support structure, the support structure including a guide configured to receive a portion of the flexible member not in tension between the drive and the trolley.

4. The lift assembly of claim 3 wherein each drive assembly includes a second flexible member having a first end connected to the trolley and a second end connected to an end of the first-mentioned flexible member remote from the trolley.

5. The lift assembly of claim 4 wherein the first-mentioned flexible member and the second flexible member of each drive assembly form a loop such that the second flexible member is configured to pull the portion of the first-mentioned flexible member not in tension between the drive and the trolley along the guide.

6. The lift assembly of 5 wherein the trolley drive assemblies are arranged in pairs with a first trolley drive assembly of each pair stacked upon a second trolley drive assembly of each pair such that the guide rail of the first trolley drive assembly is disposed above the guide rail of the second trolley drive assembly.

7. The lift assembly of claim 6 and further comprising a mechanical hard stop to limit movement of each of the trolleys on each corresponding guide rail.

8. The lift assembly of claim 1 and further comprising a plurality of wire ropes configured to couple each trolley to the corresponding hitch point, and wherein each trolley drive assembly includes a tension leveling assembly configured to maintain substantially the same amount of tension in each wire rope coupled to each corresponding trolley.

9. The lift assembly of claim 8 wherein the tension leveling assembly comprises a plurality of elongated rods, wherein an elongated rod is coupled to each one of the wire ropes and coupled to each corresponding trolley wherein displacement of the elongated rod relative to the trolley adjusts the tension in the corresponding wire rope.

10. The lift assembly of claim 9 wherein each elongated rod is coupled to its corresponding trolley with a spring element.

11. The lift assembly of claim 10 and wherein each elongated rod is threaded, and wherein the tension leveling assembly comprises a plurality of nuts, wherein each nut is coupled to a spring element such that rotation of the nut adjusts the tension in the corresponding wire rope.

12. The lift assembly of claim 11 wherein each elongated rod slideably extends though an aperture in the trolley, wherein each elongated rod has threads that are on a side of the trolley opposite the corresponding wire rope, wherein the spring element is disposed between the side of the trolley and corresponding nut.

13. A lift assembly for a platform, the lift assembly comprising:

a trolley drive assembly including a trolley guidable along a guide rail, and a drive configured to displace the trolley along the guide rail;

a plurality of wire ropes for lifting the platform; and a tension leveling assembly configured to couple each of the wire ropes to the trolley and maintain substantially the same amount of tension in each wire rope; wherein the tension leveling assembly comprises a plurality of elongated rods, wherein an elongated rod is coupled to each of the wire ropes and coupled to the trolley wherein displacement of the elongated rod relative to the trolley adjusts the tension in the corresponding wire rope; and wherein each elongated rod is coupled to the trolley with a spring element.

14. The lift assembly of claim 13 and wherein each elongated rod is threaded, and wherein the tension leveling assembly comprises a plurality of nuts, wherein each nut is coupled to a spring element such that rotation of the nut adjusts the tension in the corresponding wire rope.

15. The lift assembly of claim 14 wherein each elongated rod slideably extends though an aperture in the trolley, wherein each elongated rod has threads that are on a side of the trolley opposite the corresponding wire rope, wherein the spring element is disposed between the side of the trolley and corresponding nut.

16. A ship comprising:

a vessel for holding water;

a movable platform;

a lift assembly operably coupled to the platform to lift and lower the platform, the lift assembly comprising an electric drive that operate as a generator and generates current during lowering of the platform; and an electrical resistor disposed in the vessel and connected to the drive to receive current, the electrical resistor configured to dissipate heat into the vessel.

17. The ship of claim 16 wherein the vessel is configured to hold a flow of water allow where the electrical resistor heats the flow of water.

18. The ship of claim 17 wherein the vessel includes a baffle configured to cause turbulent contact of the water with the electrical resistor.

19. The ship of claim 16 wherein the vessel is configured to hold water and vent steam, wherein the electrical resistor is configured to convert at least some of the water into steam.

* * * * *